United States Patent [19]

Bondar

[11] Patent Number: 4,843,668

[45] Date of Patent: Jul. 4, 1989

[54] HAND TOOL FOR STORING AND APPLYING O-RING SEALS

[76] Inventor: Jerry Bondar, 43 Lissom Crescent, Willowdale, Ontario, Canada, M2R 2P2

[21] Appl. No.: 157,947

[22] Filed: Feb. 18, 1988

[51] Int. Cl.[4] ..... B25F 1/00

[52] U.S. Cl. ..... 7/164; 29/235

[58] Field of Search ..... 29/235, 282, 450; 7/164, 170

[56] References Cited

U.S. PATENT DOCUMENTS

| | | | |
|---|---|---|---|
| D. 257,211 | 10/1980 | Lööf et al. | 29/235 X |
| 2,236,936 | 4/1941 | Camp | 100/31 |
| 2,388,309 | 11/1945 | Curtiss | 29/235 X |
| 2,679,654 | 6/1954 | Hosking | 7/170 |
| 3,115,701 | 12/1963 | Jones | 29/453 |
| 3,127,986 | 4/1962 | Hulka | 206/16 |
| 3,145,463 | 8/1964 | Hockett | 29/235 X |
| 3,319,325 | 5/1967 | Nessamar et al. | 29/235 |
| 3,382,015 | 5/1968 | Steidl | 29/235 X |
| 3,538,587 | 11/1970 | Shurtleff et al. | 29/235 |
| 3,604,096 | 9/1971 | Shiroma | 29/235 |
| 3,665,578 | 5/1972 | Jaquette | 29/235 X |
| 3,776,373 | 12/1973 | Mullen | 206/16 |
| 3,808,664 | 7/1974 | Jaquette | 29/235 |
| 3,827,124 | 8/1974 | Hervieux | 29/235 |
| 4,064,609 | 12/1977 | Jeppesen et al. | 29/235 |
| 4,212,096 | 6/1980 | Saito et al. | 29/235 |
| 4,291,426 | 9/1981 | Bishop, Jr. | 7/164 X |
| 4,291,451 | 9/1981 | O'Neill | 29/235 |
| 4,466,166 | 8/1984 | Hogarth | 29/235 |

FOREIGN PATENT DOCUMENTS

| | | | |
|---|---|---|---|
| 19883 | of 1905 | United Kingdom | 29/235 |

OTHER PUBLICATIONS

Two leaflets each entitled "A Complete Mix & Match System", Quality Repair Parts, 1980.

*Primary Examiner*—Howard N. Goldberg
*Assistant Examiner*—Andrew E. Rawlins
*Attorney, Agent, or Firm*—Ridout & Maybee

[57] ABSTRACT

In order to facilitate the application of O-ring seals to, for example, a faucet valve stem having a serrated upper end portion and a lead screw having relatively sharp edges which would tend to cut or abrade an O-ring seal there is provided a hand tool having an elongated tube, one end of which presents an expansion member, and the other end of which presents a head member. A plurality of O-ring seals are mounted on the tube in stacked relationship, with each O-ring seal being operatively rolled over a divergent walled portion of the expansion member thereby smoothly and uniformly to expand the O-ring seal, and then being rolled along a plurality of equi-angularly spaced, resiliently deformable prongs for application to the valve stem while the serrated upper end portion and the lead screw of the valve stem are disposed within these prongs. The tool also serves to store the O-ring seals in an orderly and convenient manner prior to use.

10 Claims, 1 Drawing Sheet

HAND TOOL FOR STORING AND APPLYING O-RING SEALS

BACKGROUND OF THE INVENTION

This invention is concerned with the provision of a hand tool for storing and for applying O-ring seals, such as for applying O-ring seals to faucet valve stems. Conventionally the upper end portion of a faucet valve stem is of, for example, serrated form comprising a plurality of longitudinally extending spline grooves so that a handle may be non-rotatably mounted on this upper end portion of the valve stem, turning of the handle operatively causing turning of the valve stem with resultant opening or closing of the faucet valve as a result of the action of a lead screw provided on the valve stem. In mounting such a faucet valve stem it is usually necessary for sealing purposes to provide on the valve stem at least one O-ring seal which is disposed at the required position on the valve stem by being manually resiliently expanded and moved along the valve stem over the serrated upper end portion thereof and the lead screw to the required position which is usually constituted by an annular groove between two annular shoulders. However, this procedure of manually disposing the resiliently expanded O-ring seal over the serrated upper end portion of the valve stem and over the lead screw can be relatively time-consuming since it is an awkward and cumbersome procedure, and furthermore since the serrated upper end portion of the valve stem and the lead screw frequently have relatively sharp edges this disposition of the O-ring seal over the serrated upper end portion and the lead screw can result in the surface of the O-ring seal being cut or abraded with the result that when the faucet valve stem is operatively installed there may be leakage of water past the O-ring seal.

SUMMARY OF THE INVENTION

It is a primary object of the present invention to provide a hand tool for applying O-ring seals to, for example, faucet valve stems as described above, and which permits the above-described disadvantages of the conventional procedure for applying O-ring seals to faucet valve stems to be substantially overcome or at least mitigated. Furthermore, a hand tool according to the present invention provides for storing O-ring seals in a convenient and orderly manner, thereby overcoming the obvious disadvantages wherein O-ring seals of a variety of thicknesses and diameters are mixed together in a single container.

In accordance with the present invention there is provided a hand tool for storing and applying O-ring seals, comprising an elongated member having one end and an opposed end and on which a plurality of O-rings seals are mounted in stacked relationship, and an expansion member having one end and which is connected to the elongated member with said one end of the expansion member adjacent to said one end of the elongated member. The expansion member has a portion, the walls of which are divergent in the direction from said one end of the expansion member, and the expansion member has an opposed end portion comprising a plurality of spaced, resiliently deformable prongs. A head member is connected to said opposed end of the elongated member. with the head member extending laterally outwardly of the elongated member.

Such a hand tool may be provided in which the elongated member, the expansion member and the head member are in a disassembled condition, the elongated member being adapted to receive a plurality of O-ring seals mounted in stacked relationship thereon said one end of the expansion member being adapted to be connected to said one end of the elongated member, and the head member being adapted to be connected to said opposed end of the elongated member.

BRIEF DESCRIPTION OF THE DRAWINGS

In order that the invention may be more clearly understood and more readily carried into effect the same will now, by way of example, be more fully described with reference to the accompanying drawings in which.

DESCRIPTION OF THE PREFERRED EMBODIMENT

Figure 1:
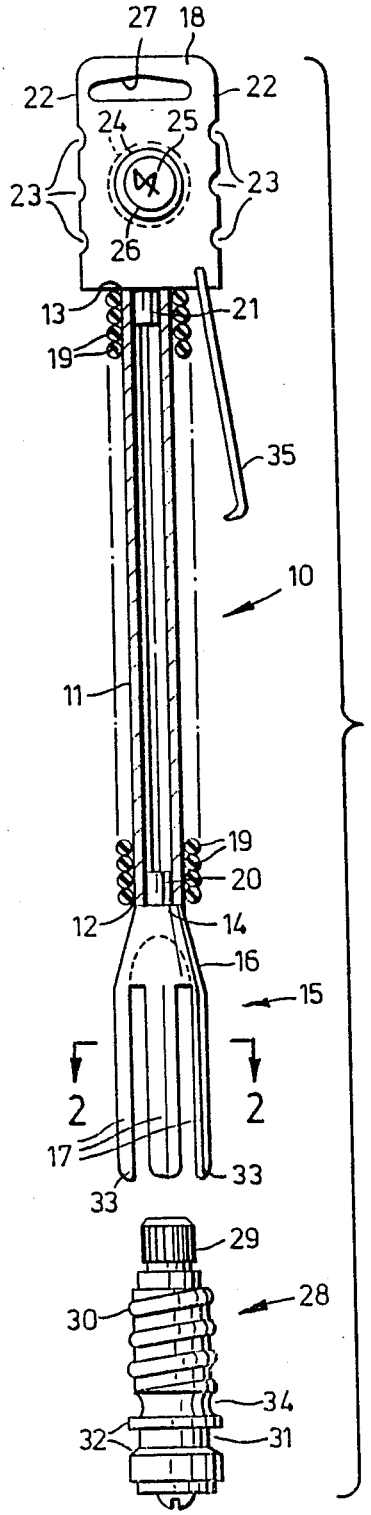
FIG. 1 is a partially sectioned side view of a hand tool according to a preferred embodiment of the present invention, the view also showing a faucet valve stem to which an O-ring seal may be applied by means of the hand tool.
Figure 2:
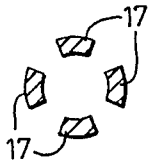
FIG. 2 is a sectioned view on the line 2—2 in FIG. 1.

Referring to the accompanying drawings, 10 denotes generally a hand tool according to a preferred embodiment of the invention, the hand tool 10 comprising an elongated member 11 which preferably comprises a hollow, elongated cylindrical tube having one end 12 and an opposed end 13. One end 14 of an expansion member 15 is connected to the end 12 of the tube 11 so that the expansion member 15 is presented by the tube 11 with the end 14 of the expansion member 15 adjacent to the end 12 of the tube 11. A portion 16 of the expansion member 15 adjacent to the end 14 thereof has divergent walls in the direction from the end 14 of the expansion member 15, this portion 16 of the expansion member 15 preferably being of frusto-conical form as shown in the drawings. The opposed end portion of the expansion member 15 comprises a plurality of spaced, resiliently deformable prongs 17 which, in the preferred embodiment shown in the accompanying drawings, comprise four equi-angularly spaced, resiliently deformable prongs 17.

Extending from the end 13 of the tube 11 is a generally plate-like head member 18, and stored in stacked relationship on the tube 11 between the expansion member 15 and the head member 18 a is plurality of O-ring seals 19.

Preferably, the end 14 of the expansion member 15 presents a cylindrical plug 20 which is engaged within the end 12 of the tube 11, and the head member 18 likewise presents a cylindrical plug 21 which is engaged within the end 13 of the tube 11, the cylindrical plugs 20 and 21 preferably being bonded by the use of an appropriate adhesive within the respective ends 12 and 13 of the tube 11. In practice, the tube 11, the expansion member 15 and the head member 18 can be supplied by the manufacturer in a disassembled condition, so that the store or other supplier can, if appropriate by cutting the tube 11 before mounting the O-ring seals 19 on the tube 11 and assembling the tube 11, the expansion member 15 and the head member 18 with the cylindrical plugs 20 and 21 engaged within the ends 12 and 13 of the tube 11 as hereinbefore described, market the tool 10 with any desired number of the O-ring seals 19 mounted on the tube 11. Thus, for example, having regard to the requirements of its customers one store or other supplier may consider it appropriate to market the tool 10 with only, say, ten O-ring seals 19 mounted on the tube 11, in which case the tube 11 as purchased from the manufacturer can first be cut to a length appropriate to accommodate these ten O-ring seals 19 before the ten O-ring seals 19 are mounted on the tube 11, and the tube 11, with the expansion member 15 and the head member 18 are assembled together. On the other hand, having regard to the requirements of its customers a different store or other supplier may wish to market the tool 10 with, say, twenty or thirty O-ring seals 19 mounted on the tube 11, in which case, of course, this larger number of the O-ring seals 19 is mounted on the tube 11 after, if desired, the tube 11 has been cut to an appropriate length, and the tube 11, the expansion member 15 and the head member 18 are again assembled together.

The opposed edges 22 of the head member 18 may be provided with a plurality of notch gauges 23 corresponding to the thickness of O-ring seals, so that by checking an O-ring seal to be replaced using these notch gauges 23 the customer can determine the thickness of the O-ring seals which he requires. Thus, for example, the notch gauges 23 may in width be respectively 1/32 inch, 1/16 inch, 3/32 inch, 1/8 inch, 5/32 inch, and 3/16 inch. In this connection, the tool 10 or at least the head member 18 thereof may be color coded to identify the thickness of the O-ring seals 19 whcih are mounted on the tube 11 of the tool 10. Thus where the O-ring seals 19 mounted on the tube 11 of the tool 10 each have a thickness of, say, 1/32 inch the tool 10 or at least the head member 18 thereof may be colored, for example, blue, where the O-ring seals 19 mounted on the tube 11 of the tool 10 each have a thickness of, say, 1/16 inch the tool 10 or at least the head member 18 thereof may be colored, for example, yellow, etc. The expansion member 15 is preferably of molded plastics material such as, for example, nylon with the resilient deformability of the prongs 17 being resultant from the plastics material of which the expansion member 15 is formed. The tube 11 and the head member 18 may also be of plastics material which may be the same as the plastics material of which the expansion member 15 is formed. The above-described color coding of at least the head member 18 may be provided by incorporating an appropriate coloring material in the plastics material thereof.

Furthermore, the head member 18 preferably presents on one main face thereof an outwardly projecting, short cylindrical plug gauge 24, and in the preferred embodiment shown in the accompanying drawings both main faces of the head member 18 present such cylindrical plug gauges 24 of different diameters, so that the customer using an O-ring seal to be replaced can determine the inner diameter of the O-ring seals 19 which he requires, appropriate indicia 25 presented on, for example, a paper label 26 applied to the head member 18 identifying the inner diameter of each of the O-ring seals 19 which are mounted on the tube 11 of the tool 10. In practice, the same size of tool 10 may be used for O-ring seals 19 having inner diameters of two adjacent sizes over a range of sizes, with a differently sized tool 10 being used for O-ring seals 19 the inner diameters of which are of the next two adjacent sizes over the range of sizes, and so on. Thus, for example the same size of tool 10 may be used for O-ring seals 19 each of which has an inner diameter of ⅛ inch and for O-ring seals 19 each of which has an inner diameter of 5/32 inch, while a different and larger sized tool 10 may be used for O-ring seals 19 each of which has an inner diameter of 3/16 inch and for O-ring seals 19 each of which has an inner diameter of 7/32 inch, etc. The head 18 is also preferably provided with an opening 27 to facilitate hanging of the tool 10 on, for example, a pegboard display in a store or the like. Thus, in for example, a store or the like there may be displayed a number of the tools 10 having on the tubes 11 thereof O-ring seals 19 of different thickness and inner diameters, with a customer being readily able to identify by the above-described color coding and the indicia 25 which of the tools 10 he requires.

28 denotes generally a faucet valve stem which may be of conventional form and which has an upper end portion 29 of serrated form comprising a plurality of longitudinally extending spline grooves. The valve stem 28 also comprises a lead screw 30 below which there is an annular groove 31 bounded by two annular shoulders 32, an O-ring seal 19 being operatively disposed for sealing purposes within this annular groove 31 between the shoulders 32 when the valve stem 28 is in use.

In using the tool to apply an O-ring seal 19 to the valve stem 28 the tool 10 is moved relative to the valve stem 28 in the direction of the arrow A shown in FIG. 1, thereby to dispose the upper end portion 29 and the lead screw 30 of the valve stem 28 within the lower end portion of the expansion member 15 so that the equi-angularly spaced prongs 17 are disposed around the lead screw 30. With the prongs 17 so disposed around the lead screw 30 the upper end portion 29 of the valve stem 28 may be at least partially disposed within a concavity 31 which may be provided in the lower face of the portion 16 of the expansion member 15. The lowermost of the O-ring seals 19 on the tool 10 is then rolled over the divergent walls of the portion 16 of the expansion member 15, thereby smoothly and uniformly to expand this O-ring seal 19 which is then rolled along the resiliently deformable prongs 17 of the expansion member 15, this resiliency of the equi-angularly spaced prongs 17 facilitating this rolling of the O-ring seal 19 therealong. The free ends of the prongs 20 are preferably chamfered as indicated by the reference numeral 33 in FIG. 1 to facilitate smooth discharge of the O-ring seal 19 from these free ends of the prongs 17 into an annular groove 34 provided in the valve stem 28 between the lead screw 30 and the upper of the shoulders 32. The tool 10 is then removed, and this O-ring seal 19 is rolled over the upper shoulder 32 into the groove 31 thereby to complete the application of the O-ring seal 19 to the valve stem 28. Thus, the tool 10 permits an O-ring seal 19 to be applied to the valve stem 28 without the O-ring seal 19 contacting the serrated upper end portion 29 of the valve stem 28 or the lead screw 30, thereby substantially eliminating any risk of the O-ring seal 19 being cut or abraded by relatively sharp edges presented by the serrated upper end portion 29 of the valve stem 28 and particularly by the lead screw 30.

A pick 35 may be pivotally mounted on the head member 18 of the tool 10, this pick 35 which has a relatively sharp end portion 36 being useful for facilitating removal of an O-ring seal 19 which is to be replaced from the groove 31.

While a hand tool according to the present invention has herein been specifically described and illustrated with reference to the application of O-ring seals to a faucet valve stem it will, of course, be appreciated that this hand tool may also be used for applying O-ring seals to many other devices which operatively require the application thereto of one or more O-ring seals.

I claim:

1. A hand tool for storing and applying O-ring seals, comprising an elongated member having one end and an opposed end and on which a plurality of O-ring seals are mounted in stacked relationship, an expansion member having one end and which is connected to the elongated member with said one end of the expansion member adjacent to said one end of the elongated member, the expansion member having a portion, the walls of which are divergent in the direction from said one end of the expansion member, and the expansion member having an opposed end portion comprising a plurality of spaced, resiliently deformable prongs, and a head member connected to said opposed end of the elongated member with the head member extending laterally outwardly of the elongated member.

2. A hand tool according to claim 1, wherein the expansion member is of molded plastics material.

3. A hand tool according to claim 1, wherein the plurality of spaced, resiliently deformable prongs of the expansion member comprises four equiangularly spaced prongs.

4. A hand tool according to claim 1, wherein the elongated member comprises a hollow, elongated cylindrical tube, said one end of the expansion member presents a cylindrical plug which is engaged within the cylindrical tube at said one end thereof to connect said one end of the expansion member to said one end of the elongated member, and the head member presents a cylindrical plug which is engaged within the cylindrical tube at said opposed end thereof to connect the head member to said opposed end of the elongated member.

5. A hand tool according to claim 4, wherein the cylindrical plug presented by the expansion member is bonded within the cylindrical tube at said one end thereof, and the cylindrical plug presented by the head member is bonded within the cylindrical tube at said opposed end thereof.

6. A hand tool according to claim 1, wherein the head member presents at least one outwardly projecting, short cylindrical plug gauge for the inner diameter of O-ring seals.

7. A hand tool according to claim 1, wherein the head member has notch gauges for the thickness of O-ring seals.

8. A hand tool according to claim 1, wherein the head member is color coded to identify the thickness of each of the O-ring seals mounted on the elongated member.

9. A hand tool according to claim 1, wherein the head member bears indicia to identify the inner diameter of each of the O-ring seals mounted on the elongated member.

10. A hand tool according to claim 1, further comprising an O-ring seal removal pick presented by the head member.

* * * * *